US011142808B2

(12) United States Patent
Noh et al.

(10) Patent No.: US 11,142,808 B2
(45) Date of Patent: Oct. 12, 2021

(54) STEEL FOR PIPES HAVING HIGH FATIGUE RESISTANCE, METHOD OF MANUFACTURING THE SAME, AND WELDED STEEL PIPE USING THE SAME

(71) Applicant: POSCO, Pohang-si (KR)

(72) Inventors: Kyung Min Noh, Gwangyang-si (KR); Min Sung Joo, Gwangyang-si (KR); Ki Seok Kim, Incheon (KR); Young Hune Kim, Pohang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 15/701,039

(22) Filed: Sep. 11, 2017

(65) Prior Publication Data

US 2018/0073097 A1 Mar. 15, 2018

(30) Foreign Application Priority Data

Sep. 12, 2016 (KR) ..... 10-2016-0117505

(51) Int. Cl.

| | |
|---|---|
| ***C21D 9/08*** | (2006.01) |
| ***C21D 8/10*** | (2006.01) |
| ***C21D 6/00*** | (2006.01) |
| ***C22C 38/50*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/48*** | (2006.01) |

(52) U.S. Cl.

CPC ..... *C21D 9/08* (2013.01); *C21D 6/004* (2013.01); *C21D 6/005* (2013.01); *C21D 6/008* (2013.01); *C21D 8/0263* (2013.01); *C21D 8/105* (2013.01); *C22C 38/001* (2013.01); *C22C 38/002* (2013.01); *C22C 38/02* (2013.01); *C22C 38/04* (2013.01); *C22C 38/42* (2013.01); *C22C 38/44* (2013.01); *C22C 38/48* (2013.01); *C22C 38/50* (2013.01); *C21D 8/0226* (2013.01); *C21D 2211/005* (2013.01); *C21D 2211/009* (2013.01)

(58) Field of Classification Search

CPC ..... C21D 2211/005; C21D 2211/009; C21D 6/004; C21D 6/005; C21D 6/008; C21D 8/0226; C21D 8/0263; C21D 8/105; C21D 9/08; C22C 38/001; C22C 38/002; C22C 38/02; C22C 38/04; C22C 38/42; C22C 38/44; C22C 38/48; C22C 38/50

See application file for complete search history.

(56) References Cited

U.S. PATENT DOCUMENTS

| | | | |
|---|---|---|---|
| 2003/0047257 | A1 | 3/2003 | Kami et al. |
| 2015/0004050 | A1 | 1/2015 | Matsuki et al. |
| 2015/0140358 | A1 | 5/2015 | Yokoyama et al. |
| 2016/0184875 | A1 | 6/2016 | Noh et al. |

FOREIGN PATENT DOCUMENTS

| | | | |
|---|---|---|---|
| CN | 1386141 | A | 12/2002 |
| CN | 102912228 | A | 2/2013 |
| CN | 102912250 | A | 2/2013 |
| CN | 103249854 | A | 8/2013 |
| CN | 104364408 | A | 2/2015 |
| CN | 104726774 | A | 6/2015 |
| CN | 104053805 | B | 10/2016 |
| EP | 2752499 | B1 | 5/2016 |
| JP | H07-286214 | A | 10/1995 |
| KR | 10-2011-0130987 | A | 12/2011 |
| KR | 10-2013-0105008 | A | 9/2013 |
| KR | 10-2014-0104497 | A | 8/2014 |
| KR | 10-2016-0077499 | A | 7/2016 |
| KR | 10-2016-0080282 | A | 7/2016 |

OTHER PUBLICATIONS

Chinese Office Action dated Dec. 3, 2018 issued in Chinese Patent Application No. 201710818766.4.

*Primary Examiner* — Jenny R Wu

(74) *Attorney, Agent, or Firm* — Morgan, Lewis & Bockius LLP

(57) ABSTRACT

Provided is a steel for pipes for use in applications such as oil or gas extraction. Particularly, there are provided a steel for pipes having high fatigue resistance, a method of manufacturing the steel, and a welded steel pipe obtained using the steel.

7 Claims, No Drawings

STEEL FOR PIPES HAVING HIGH FATIGUE RESISTANCE, METHOD OF MANUFACTURING THE SAME, AND WELDED STEEL PIPE USING THE SAME

CROSS-REFERENCE TO RELATED APPLICATION(S)

This application claims benefit of priority to Korean Patent Application No. 10-2016-0117505 filed on Sep. 12, 2016 in the Korean Intellectual Property Office, the disclosure of which is incorporated herein by reference in its entirety.

BACKGROUND

1. Field

The present disclosure relates to a steel for pipes for use in applications such as oil or gas extraction, and more particularly, to a steel for pipes having high fatigue resistance, a method of manufacturing the steel, and a welded steel pipe obtained using the steel.

2. Description of Related Art

In recent years, environments in which oil wells and gas wells (hereinafter collectively referred to as oil wells) are developed have become increasingly harsh, and efforts are underway to decrease production costs and thus improve profitability.

Coiled tubing refers to a welded pipe having an outer diameter of about 20 mm to about 100 mm and a length of greater than 1 km which is coiled around a reel. During work, the coiled tubing is unwound from the reel and inserted into an oil well, and after work, the coiled tubing is rewound around the reel.

Coiled tubing is a product made through a process in which skelp, obtained by slitting a hot-rolled coil, is welded to have a long length, formed into a pipe by electric resistance welding, and coiled around a large reel for use in the manner of a water hose, and since such coiled tubing having a length of several kilometers (km) is previously formed, installation times may be decreased. Thus, demand for coiled tubing has gradually increased.

Since coiled tubing is repeatedly wound around and unwound from a reel, materials for coiled tubing are required to have good surface characteristics and high fatigue resistance.

In addition, it is important to control weld zones of materials for coiled tubing because if weld zones have defects or lower strength than a base metal, breakage may occur due to concentration of stress and accumulation of fatigue. (Patent Document 1) Korean Patent Application Laid-open Publication No. 2014-0104497

SUMMARY

Aspects of the present disclosure may provide a steel for pipes having strength equivalent to that of API 5ST CT90 and high fatigue resistance as well, a method of manufacturing the steel, and a welded steel pipe obtained by welding the steel.

According to an aspect of the present disclosure, a steel for pipes having high fatigue resistance may include, by wt %, carbon (C): 0.10% to 0.15%, silicon (Si): 0.30% to 0.50%, manganese (Mn): 0.8% to 1.2%, phosphorus (P): 0.025% or less, sulfur (S): 0.005% or less, niobium (Nb): 0.01% to 0.03%, chromium (Cr): 0.5% to 0.7%, titanium (Ti): 0.01% to 0.03%, copper (Cu): 0.1% to 0.4%, nickel (Ni): 0.1% to 0.3%, nitrogen (N): 0.008% or less, and a balance of iron (Fe) and inevitable impurities, wherein chromium (Cr), copper (Cu), and nickel (Ni) may satisfy the following formula, and the steel may have a microstructure including ferrite having a grain size of 10 μm or less and pearlite.

$$80<100(Cu+Ni+Cr)+(610-CT)<120 \quad \text{[Formula]}$$

where Cu, Ni, and Cr respectively refer to Cu, Ni, and Cr contents by weight, and CT refers to a coiling temperature (° C.).

According to another aspect of the present disclosure, a method of manufacturing a steel for pipes having high fatigue resistance may include: preparing a steel slab having the above-described alloying composition; reheating the steel slab to a temperature within a range of 1100° C. to 1300° C.; rough rolling the reheated steel slab at a temperature within a range of 900° to 1100°; after the rough rolling, finish hot rolling the steel slab at a temperature within a range of 800° C. to 900° C. to produce a hot-rolled steel sheet; and after cooling the hot-rolled steel sheet, coiling the steel sheet at a coiling temperature (CT) satisfying the above formula.

According to another aspect of the present disclosure, there is provided a welded steel pipe having high fatigue resistance and obtained by forming and welding the steel.

DETAILED DESCRIPTION

The inventors have conducted research into improving the physical properties of materials suitable for coiled tubing which is continually increasingly in demand for oil or gas extraction. Particularly, it was attempted to provide a steel for pipes having satisfactory fatigue characteristics while having strength (a yield strength of 620 MPa to 689 MPa and a tensile strength of 669 MPa or greater) equivalent to that of API 5ST CT90 after being manufactured as welded steel pipes.

As a result, the inventors have found that a steel for pipes having intended physical properties can be provided by optimizing the relationship between particular elements and manufacturing conditions having an effect on fatigue characteristics in addition to optimizing alloying elements and manufacturing conditions. Based on this knowledge, the inventors have invented the present invention.

Embodiments of the present disclosure will now be described in detail.

According to an aspect of the present disclosure, a steel for pipes having high fatigue resistance may have an alloying composition including, by wt %, carbon (C): 0.10% to 0.15%, silicon (Si): 0.30% to 0.50%, manganese (Mn): 0.8% to 1.2%, phosphorus (P): 0.025% or less, sulfur (S): 0.005% or less, niobium (Nb): 0.01% to 0.03%, chromium (Cr): 0.5% to 0.7%, titanium (Ti): 0.01% to 0.03%, copper (Cu): 0.1% to 0.4%, nickel (Ni): 0.1% to 0.3%, and nitrogen (N): 0.008% or less.

Hereinafter, the reason for limiting the alloy composition of the steel for pipes of the present disclosure as described above will be described in detail. In the following description, the content of each element is given in wt % unless otherwise specified.

Carbon (C): 0.10% to 0.15%

Carbon (C) is an element increasing the hardenability of steel. If the content of carbon (C) is less than 0.10%, hardenability does not sufficiently increase, and thus strength intended in the present disclosure is not guaranteed. Conversely, if the content of carbon (C) exceeds 0.15%, yield strength excessively increases, which may make it difficult to perform forming processes and may decrease fatigue resistance.

Therefore, according to the present disclosure, it may be preferable to adjust the content of carbon (C) to be within the range of 0.10% to 0.15%.

Silicon (Si): 0.30% to 0.50%

Silicon (Si) increases the activity of carbon (C) in ferrite and promotes the stabilization of ferrite, thereby contributing to guaranteeing strength by solid solution strengthening. In addition, silicon (Si) forms low-melting-point oxides such as $Mn_2SiO_4$ during electric resistance welding, thereby making it easy to discharge oxides during welding.

However, if the content of silicon (Si) is less than 0.30%, cost problems occur in steelmaking, and if the content of silicon (Si) exceeds 0.50%, a large amount of $SiO_2$ being a high-melting-point oxide may be formed in addition to the formation of $Mn_2SiO_4$, thereby decreasing the toughness of weld zones during electric resistance welding.

Therefore, according to the present disclosure, it may be preferable to adjust the content of silicon (Si) to be within the range of 0.30% to 0.50%.

Mn (Manganese): 0.8% to 1.2%

Manganese (Mn) is an element effective in strengthening steel by solid solution strengthening. When the content of manganese (Mn) is 0.8% or more, the effect of increasing hardenability may be obtained, and a strength level intended in the present disclosure may be guaranteed. However, if the content of manganese (Mn) exceeds 1.2%, a segregation region markedly develops in the center portions of slabs, formed by casting in a steelmaking process, in a thickness direction, and the fatigue resistance of final products decreases.

Therefore, according to the present disclosure, it may be preferable to adjust the content of manganese (Mn) to be within the range of 0.8% to 1.2%.

Phosphorus (P): 0.025% or less

Phosphorus (P) is an impurity inevitably present in steel and decreasing the toughness of steel, and thus a lower content of phosphorus (P) is favored. However, the content of phosphorus (P) may be adjusted to be 0.025% or less due to costs in a steelmaking process.

Sulfur (S): 0.005% or less

Sulfur (S) is an element which is likely to form coarse inclusions and cause a toughness decrease and crack propagation, and thus the content of sulfur (S) may be adjusted to be as low as possible. However, the content of sulfur (S) may be adjusted to be 0.005% or less due to costs in a steelmaking process. More preferably, the content of sulfur (S) may be adjusted to be 0.002% or less.

Niobium (Nb): 0.01% to 0.03%

Niobium (Nb) is an element having a significant effect on the strength of steel by forming precipitates. Niobium (Nb) improves the strength of steel by precipitating carbonitrides in steel or inducing solid solution strengthening in iron (Fe). In particular, Nb-based precipitates dissolve during a slab reheating process and then finely precipitate during a hot rolling process, thereby effectively increasing the strength of steel.

However, if the content of niobium (Nb) is less than 0.01%, fine precipitates may not be sufficiently formed, and thus a strength level intended in the present disclosure may not be obtained. Conversely, if the content of niobium (Nb) exceeds 0.03%, manufacturing costs may increase.

Therefore, according to the present disclosure, it may be preferable to adjust the content of niobium (Nb) to be within the range of 0.01% to 0.03%.

Chromium (Cr): 0.5% to 0.7%

Chromium (Cr) is an element improving hardenability and corrosion resistance. If the content of chromium (Cr) is less than 0.5%, the effect of improving corrosion resistance may not be sufficiently obtained by the addition of chromium (Cr). Conversely, if the content of chromium (Cr) exceeds 0.7%, weldability may markedly decrease.

Therefore, according to the present disclosure, it may be preferable to adjust the content of chromium (Cr) to be within the range of 0.5% to 0.7%.

Titanium (Ti): 0.01% to 0.03%

Titanium (Ti) forms TiN by reacting with nitrogen (N) and thus suppresses the growth of austenite grains in weld heat affected zones (HAZs) as well as in slabs during a reheating process, thereby increasing the strength of steel.

To this end, titanium (Ti) may be added in an amount of greater than 3.4×N (wt %), that is, preferably, in an amount of 0.01% or greater. However, if the amount of titanium (Ti) is excessive, toughness may decrease due to coarsening of TiN or the like, and thus the upper limit of the content of titanium (Ti) may preferably be set to 0.03%.

Copper (Cu): 0.1% to 0.4%

Copper (Cu) is effective in improving the hardenability and corrosion resistance of a base metal or weld zones. However, if the content of copper (Cu) is less than 0.1%, it may be difficult to guarantee corrosion resistance. Conversely if the content of copper (Cu) exceeds 0.4%, manufacturing costs may increase, and thus it is not economically advisable.

Therefore, according to the present disclosure, it may be preferable to adjust the content of copper (Cu) to be within the range of 0.1% to 0.4%.

Nickel (Ni): 0.1% to 0.3%

Nickel (Ni) is an element effective in improving hardenability and corrosion resistance. In addition, when added together with copper (Cu), nickel (Ni) reacts with copper (Cu) and hinders the formation of a low-melting-point copper (Cu) phase, thereby suppressing the formation of cracks during a hot working process. In addition, nickel (Ni) is effective in improving the toughness of a base metal.

In order to obtain the above-mentioned effects, nickel (Ni) is added in an amount of 0.1% or greater. However, since nickel (Ni) is an expensive element, adding more than 0.3% nickel (Ni) is not economically advisable.

Therefore, according to the present disclosure, it may be preferable to adjust the content of nickel (Ni) to be within the range of 0.1% to 0.3%.

Nitrogen (N): 0.008% or less (excluding 0%)

Nitrogen (N) combines with elements such as titanium (Ti) or aluminum (Al) in steel and fixes such elements as nitrides. However, if the content of nitrogen (N) exceeds 0.008%, more amounts of such elements are inevitably added.

Therefore, according to the present disclosure, it may be preferable to adjust the content of nitrogen (N) to be within the range of 0.008% or less.

In the present disclosure, the other components are iron (Fe) and inevitable impurities. However, other alloying elements may be added within the scope or idea of the present invention.

For example, according to the present disclosure, molybdenum (Mo) may be additionally added in addition to the above-described alloying elements.

Specifically, molybdenum (Mo) is an element markedly increasing hardenability and effective not only in improving the strength of the steel but also in improving the fatigue resistance of the steel. However, molybdenum (Mo) is an expensive element, and thus if added in large amounts, manufacturing costs may increase. Therefore, it may be preferable to adjust the content of molybdenum (Mo) to be within the range of 0.2% or less.

According to the present disclosure, the steel for pipes having the above-described composition may satisfy the following formula expressing a relationship among copper (Cu), nickel (Ni), and chromium (Cr), $$80<100(Cu+Ni+Cr)+(610-CT)<120 \quad \text{[Formula]}$$

(where Cu, Ni, and Cr respectively refer to Cu, Ni, and Cr contents by weight, and CT refers to a coiling temperature (° C.)).

All of the elements, copper (Cu), nickel (Ni), and chromium (Cr), are effective in improving the fatigue resistance of the steel. If the contents of these elements are low, an intended strength level may not be obtained, and thus it may be necessary to markedly decrease the coiling temperature. Conversely, if the contents of these elements are excessive, it may be necessary to increase the coiling temperature.

As will be described later, if the coiling temperature deviates from a certain range, an intended microstructure may not be obtained.

Therefore, copper (Cu), nickel (Ni), and chromium (Cr) may be controlled to satisfy the above-mentioned relationship within a proposed coiling temperature range.

The steel for pipes of the present disclosure satisfying the above-described alloying composition and compositional relationship may have a composite-phase microstructure including ferrite and pearlite.

Preferably, the ferrite may have a grain size of 10 μm or less. If the grain size of ferrite exceeds 10 μm, fatigue propagation to grain boundaries may easily occur, and thus it may be difficult to guarantee fatigue resistance. The grain size refers to a circle equivalent diameter.

More specifically, it may be preferable that the microstructure of the steel include ferrite in an area fraction of 50% to 80% and pearlite in an area fraction of 20% to 50%. Since pearlite is more effective in suppressing fatigue propagation than other phases, it may be preferable that the area fraction of pearlite be within the range of 20% or greater. However, since the upper limit of the content of carbon (C) in the alloying composition of the present disclosure is 0.15 wt %, pearlite may be formed up to 50 area %.

Hereinafter, a method of manufacturing a steel for pipes, having high fatigue resistance, will be described according to another aspect of the present disclosure.

According to the present disclosure, a steel for pipes may be manufactured by preparing a steel slab having the alloying composition and compositional relationship proposed in the present disclosure, and performing a reheating process, a hot rolling process, a cooling process, and a coiling process on the steel slab. Hereinafter, each process will be described in detail.

[Reheating Process]

The reheating process is a process for heating steel to smoothly perform a subsequent rolling process and obtain intended physical properties of a steel sheet, and to this end, the reheating process is performed within a proper temperature range.

In the present disclosure, it may be preferable that the reheating process be performed at a temperature within a range of 1100° C. to 1300° C. If the reheating temperature is lower than 1100° C., it may be difficult to completely dissolve niobium (Nb) and thus to obtain a sufficient degree of strength. Conversely, if the reheating temperature is higher than 1300° C., initial grains may be excessively coarse, and thus it may be difficult to refine grains.

[Hot Rolling Process]

The steel slab reheated as described above may be subjected to rough rolling and finish hot rolling to produce a hot-rolled steel sheet.

At this time, the rough rolling may preferably be performed at a temperature within a range of 900° C. to 1100° C. If the rough rolling is finished at a temperature lower than 900° C., the risk of load problems of rolling equipment may increase.

After the rough rolling, the finish hot rolling may preferably be performed at a temperature within a range of 800° C. to 900° C. which is a non-crystallization temperature range. If the finish hot rolling is performed at a temperature lower than 800° C., there is a risk of malfunctioning due to the rolling load. Conversely, if the finish hot rolling is performed at a temperature higher than 900° C., a coarse microstructure may be ultimately formed, and thus an intended degree of strength may not be guaranteed.

Therefore, according to the present disclosure, during hot rolling, it may be preferable to adjust the temperature of rough rolling to be within the range of 900° to 1100° and the temperature of finish hot rolling to be within the range of 800° C. to 900° C.

[Cooling and Coiling Processes]

The hot-rolled steel sheet produced as described above may be cooled and coiled.

The cooling is performed to improve the strength and toughness of the steel sheet. As the rate of cooling increase, the toughness of the steel sheet improves owing to grain refinement in the internal structure of the steel sheet, and the strength of the steel sheet improves owing to the development of hard phases in the internal structure of the steel sheet.

According to the present disclosure, it may be preferable to adjust the rate of cooling to be within the range of 50° C./s or less. If the rate of cooling exceeds 50° C./s, low-temperature transformation phases such as bainite may increase, and thus there may be a high possibility that strength higher than an intended level may be obtained or fatigue resistance may be decreased. In this case, although the lower limit of the rate of cooling is not limited to a particular value, it may be preferable that the rate of cooling be 10° C./s or greater.

In addition, the cooling may be performed to a coiling temperature. According to the present disclosure, the coiling may be performed at a coiling temperature (CT) satisfying the above-described formula so as to obtain a steel for pipes having satisfactory fatigue characteristics.

Preferably, the coiling temperature may be within the range of 590° C. to 630° C. If the coiling temperature is lower than 590° C., low-temperature transformation phases such as bainite may be locally formed, and stress may be concentrated, thereby lowering fatigue resistance. Conversely, if the coiling temperature exceeds 630° C., the size of pearlite grains may excessively increase, and thus fatigue resistance may decrease.

A welded steel pipe may be manufactured using the hot-rolled steel sheet produced as described above. For example, coiled tubing may be manufactured by picking the hot-rolled steel sheet to remove scale from the surfaces of the hot-rolled steel sheet, slitting the hot-rolled steel sheet into predetermined widths, and performing a pipe-making process on the slit hot-rolled steel sheet.

A method for manufacturing the welded steel pipe is not limited. For example, an electric resistance welding method having high economical efficiency may be used. Electric resistance welding may be performed by any method. That is, electric resistance welding is not limited to a particular method.

The welded steel pipe obtained according to the present disclosure may have intended physical properties: a yield strength of 620 MPa to 689 MPa, a tensile strength of 669 MPa or greater, and a fatigue life of 1000 or greater and may be suitable for coiled tubing.

Hereinafter, the present disclosure will be described more specifically according to examples. However, the following examples should be considered in a descriptive sense only and not for the purposes of limitation. The scope of the present invention is defined by the appended claims, and modifications and variations may be reasonably made therefrom.

EXAMPLES

Steel slabs having the alloy compositions shown in Table 1 below were subjected to reheating, finishing hot rolling, cooling, and coiling under the conditions shown in Table 2 below, so as to manufacture hot-rolled steel sheets.

The microstructure of each of the hot-rolled steel sheets was observed, and results thereof are shown in Table 3 below.

Thereafter, the hot-rolled steel sheets were subjected to an electric resistance welding pipe-making process, and then the yield strength and tensile strength thereof were measured. Results of the measurement are shown in Table 3 below. At that time, tests were conducted in accordance with the conventional ASTM A370.

In addition, fatigue life was measured through a tension and compression test in which the time of facture was set as a criterion for the fatigue life. When the fatigue life was measured, strain was 0.9%. Results of the measurement are also shown in Table 3.

TABLE 1

| | Alloying composition (wt %) | | | | | | | | | | | |
|---|---|---|---|---|---|---|---|---|---|---|---|---|
| Steels | C | Si | Mn | P | S | Nb | Cr | Ti | Cu | Ni | Mo | N |
| *IS1 | 0.12 | 0.36 | 0.90 | 0.012 | 0.002 | 0.01 | 0.50 | 0.01 | 0.3 | 0.25 | 0 | 0.005 |
| IS2 | 0.12 | 0.34 | 0.85 | 0.011 | 0.002 | 0.02 | 0.59 | 0.01 | 0.3 | 0.19 | 0.10 | 0.004 |
| IS3 | 0.12 | 0.34 | 0.85 | 0.013 | 0.002 | 0.02 | 0.59 | 0.01 | 0.3 | 0.20 | 0.15 | 0.003 |
| **CS1 | 0.12 | 0.34 | 0.85 | 0.011 | 0.002 | 0.02 | 0.59 | 0.02 | 0.3 | 0.19 | 0.22 | 0.005 |
| CS2 | 0.12 | 0.30 | 0.80 | 0.011 | 0.002 | 0.02 | 0.60 | 0.015 | 0.3 | 0.25 | 0.35 | 0.005 |
| CS3 | 0.13 | 0.32 | 0.90 | 0.011 | 0.002 | 0.02 | 0.55 | 0.012 | 0.3 | 0.23 | 0.35 | 0.004 |
| CS4 | 0.12 | 0.33 | 0.85 | 0.011 | 0.002 | 0.02 | 0.59 | 0.013 | 0.28 | 0.17 | 0.34 | 0.006 |
| CS5 | 0.15 | 0.32 | 0.88 | 0.011 | 0.002 | 0 | 0.58 | 0.014 | 0.29 | 0.24 | 0.30 | 0.007 |
| CS6 | 0.12 | 0.35 | 0.82 | 0.011 | 0.002 | 0 | 0.60 | 0.014 | 0.3 | 0.17 | 0 | 0.004 |

*IS: Inventive Steel,

**CS: Comparative Steel

TABLE 2

| | Manufacturing conditions | | | | |
|---|---|---|---|---|---|
| Steels | Reheating temperature (° C.) | Finish hot rolling temperature (° C.) | Coiling temperature (° C.) | Cooling rate (° C./s) | Value of formula |
| *IS1 | 1275 | 834 | 600 | 48 | 115 |
| IS2 | 1266 | 841 | 630 | 45 | 88 |
| IS3 | 1287 | 842 | 624 | 45 | 95 |
| **CS1 | 1266 | 850 | 649 | 43 | 69 |
| CS2 | 1256 | 849 | 602 | 49 | 123 |
| CS3 | 1277 | 847 | 570 | 51 | 148 |
| CS4 | 1244 | 851 | 580 | 51 | 134 |
| CS5 | 1236 | 835 | 550 | 53 | 171 |
| CS6 | 1261 | 842 | 650 | 44 | 67 |

*IS: Inventive Steel,

**CS: Comparative Steel (Rough rolling was performed at a temperature within a range of 900° C. to 1100° C. after reheating)

TABLE 3

| | Microstructure | | Mechanical properties | | |
|---|---|---|---|---|---|
| Steels | Phase structure (fraction %) | F grain size (μm) | YS (MPa) | TS (MPa) | Fatigue life ($N_f$) |
| *IS1 | 71F + 29P | 8 | 669 | 741 | 1018 |
| IS2 | 68F + 32P | 8.4 | 666 | 730 | 1124 |
| IS3 | 70F + 30P | 7.8 | 645 | 733 | 1006 |
| **CS1 | 65F + 35P | 11 | 635 | 733 | 764 |
| CS2 | 67F + 8B + 25P | 6.8 | 652 | 788 | 941 |
| CS3 | 67F + 13B + 20P | 4.2 | 678 | 831 | 969 |
| CS4 | 68F + 11B + 21P | 4.6 | 707 | 827 | 873 |
| CS5 | 67F + 9B + 19P + 5M | 7 | 825 | 920 | 754 |
| CS6 | 64F + 36P | 9 | 669 | 718 | 920 |

*IS: Inventive Steel,

**CS: Comparative Steel (In Table 3, 'F' denotes ferrite, 'P' denotes pearlite, 'B' denotes bainite, and 'M' denotes martensite)

As shown in Tables 1 to 3, Inventive steels 1 to 3, satisfying both the alloy composition and the manufacturing conditions proposed in the present disclosure, had a high fatigue life within the range of 1000 or greater after being manufactured into welded steel pipes.

However, Comparative Steels 1 to 6, not satisfying the alloy composition and the manufacturing conditions proposed in the present disclosure, had poor fatigue life because of the formation of a coarse microstructure or low-temperature transformation phases.

As set forth above, the present disclosure may provide a steel for pipes having not only strength equivalent to API 5ST CT90 but also high fatigue resistance even after being manufactured into a steel pipe through a forming process and a welding process.

The welded steel pipe obtained by forming and welding the steel of the present disclosure may be suitable for use as coiled tubing.

What is claimed is:

1. A steel for pipes, the steel consisting of, by wt %, carbon (C): 0.10% to 0.15%, silicon (Si): 0.30% to 0.50%, manganese (Mn): 0.8% to 1.2%, phosphorus (P): 0.025% or less, sulfur (S): 0.005% or less, niobium (Nb): 0.01% to 0.03%, chromium (Cr): 0.5% to 0.7%, titanium (Ti): 0.01% to 0.03%, copper (Cu): 0.1% to 0.4%, nickel (Ni): 0.1% to 0.3%, nitrogen (N): 0.008% or less, and a balance of iron (Fe) and inevitable impurities, wherein chromium (Cr), copper (Cu), and nickel (Ni) satisfy the following formula, wherein the steel has a microstructure comprising ferrite having a grain size of 10 pm or less, in an area fraction of 50% to 80%, and pearlite in an area fraction of 20% to 50%, $$80<100(Cu+Ni+Cr)+(610-CT)<120 \quad \text{[Formula]}$$

where Cu, Ni, and Cr respectively refer to Cu, Ni, and Cr contents by weight, and CT refers to a coiling temperature ° C. and the steel has a fatigue life of 1000 (Nf or greater).

2. A method of manufacturing a steel for pipes, the method comprising:

preparing a steel slab consisting of, by wt %, carbon (C): 0.10% to 0.15%, silicon (Si): 0.30% to 0.50%, manganese (Mn): 0.8% to 1.2%, phosphorus (P); 0.025% or less, sulfur (S): 0.005% or less, niobium (Nb): 0.01% to 0.03%, chromium (Cr): 0.5% to 0.7%, titanium (Ti): 0.01% to 0.03%, copper (Cu): 0.1% to 0.4%, nickel (Ni): 0.1% to 0.3%, nitrogen (N): 0.008% or less, a balance of iron (Fe) and inevitable impurities;

reheating the steel slab to a temperature within a range of 1100° C. to 1300° C.: rough rolling the reheated steel slab at a temperature within a range of 900° C. to 1100° C.; after the rough rolling, finish hot rolling the steel slab at a temperature within a range of 800° C. to 900° C. to produce a hot-roiled steel sheet; and after cooling the hot-rolled steel sheet at a cooling rate of 45° C./s, or less, coiling the steel sheet at a coiling temperature (CT) satisfying the following formula, $$80<100(Cu+Ni+Cr)+(610-CT)<120 \quad \text{[Formula]}$$

where Cu, Ni, and Cr respectively refer to Cu, Ni, and Cr contents by weight, and CT refers to the coiling temperature ° C., thereby producing the steel according to claim 1.

3. The method of claim 2, wherein the coiling of the steel sheet is performed at a temperature within a range of 590° C. to 630° C.

4. The method of claim 2, wherein the cooling rate is 43° C/s or less.

5. The method of claim 2, wherein the temperature of the finish hot rolling the steel slab is at a temperature within a range of 800° C. to 851° C. to produce a hot-rolled steel sheet.

6. The method of claim 2, wherein the temperature of the finish hot rolling the steel slab is at a temperature within a range of 800° C. to 842° C. to produce a hot-rolled steel sheet.

7. The method of claim 2, wherein the coiling temperature is within a range of 600° C. to 630° C.

* * * * *